US010246226B2

(12) United States Patent
Sudo et al.

(10) Patent No.: US 10,246,226 B2
(45) Date of Patent: Apr. 2, 2019

(54) STORAGE CASE AND HINGE STRUCTURE

(71) Applicant: NITORI HOLDINGS CO., LTD, Hokkaido (JP)

(72) Inventors: Yasuomi Sudo, Tokyo (JP); Shigehiro Uemura, Tokyo (JP)

(73) Assignee: NITORI HOLDINGS CO., LTD, Hokkaido (JP)

( * ) Notice: Subject to any disclaimer, the term of this patent is extended or adjusted under 35 U.S.C. 154(b) by 53 days.

(21) Appl. No.: 15/470,591

(22) Filed: Mar. 27, 2017

(65) Prior Publication Data

US 2017/0283130 A1 Oct. 5, 2017

(30) Foreign Application Priority Data

Apr. 1, 2016 (JP) ..... 2016-074127

(51) Int. Cl.

| | |
|---|---|
| ***B65D 43/16*** | (2006.01) |
| ***B65D 43/24*** | (2006.01) |
| ***E05B 65/00*** | (2006.01) |
| ***E05B 73/00*** | (2006.01) |
| ***E05C 17/00*** | (2006.01) |

(52) U.S. Cl.

CPC ..... *B65D 43/16* (2013.01); *B65D 43/164* (2013.01); *B65D 43/24* (2013.01); *E05B 73/00* (2013.01); *E05C 17/025* (2013.01); *B65D 2251/1008* (2013.01); *E05B 65/00* (2013.01)

(58) Field of Classification Search

CPC ..... B65D 43/24; B65D 43/16; B65D 43/164; B65D 43/163; B65D 2251/0118; Y10T 16/5402; Y10T 16/540256; Y10T 16/5029; Y10T 16/5409; Y10T 16/551

See application file for complete search history.

(56) References Cited

U.S. PATENT DOCUMENTS

| | | | | |
|---|---|---|---|---|
| 4,696,412 A * | 9/1987 | McGowan | ..... | B65D 43/167 16/257 |
| 6,092,690 A * | 7/2000 | Bitowft | ..... | B65D 43/24 206/494 |
| 2017/0107021 A1* | 4/2017 | Wu | ..... | B65D 43/161 |

FOREIGN PATENT DOCUMENTS

| | | | |
|---|---|---|---|
| CN | 202368904 | U | 8/2012 |
| CN | 102770299 | A | 11/2012 |
| JP | H11-35060 | A | 2/1999 |
| JP | 3161698 | B2 | 4/2001 |
| JP | 2014-094761 | A | 5/2014 |

(Continued)

*Primary Examiner* — Fenn C Mathew
*Assistant Examiner* — Jennifer Castriotta
(74) *Attorney, Agent, or Firm* — Studebaker & Brackett PC

(57) ABSTRACT

A storage case includes a front cover. An upper side of the front cover is rotatably connected to a top plate via a hinge structure. An outwardly protruding locking convex part is formed on the upper side of the front cover. In a first opened state where the front cover is turned upward about the upper side of the front cover as an axis, the locking convex part comes into contact with an engagement part on the top plate. When the front cover is turned upward from the first opened state and becomes in a second opened state in which the engagement part passes over the locking convex part, the locking convex part engages with the engagement part so that the front cover is locked in the second opened state. The locking convex part is recessed from a rear side of the front cover to be in a shell-shaped form.

2 Claims, 5 Drawing Sheets

(56) References Cited

FOREIGN PATENT DOCUMENTS

| | | | |
|---|---|---|---|
| JP | 2014-223934 | A | 12/2014 |
| JP | 5721688 | B2 | 5/2015 |

* cited by examiner

STORAGE CASE AND HINGE STRUCTURE

CROSS REFERENCE TO RELATED APPLICATIONS

This application claims benefit of priority to Japanese Patent Application No. 2016-074127 filed on Apr. 1, 2016, the entire content of which is incorporated herein by reference.

TECHNICAL FIELD

The present technical field relates to a storage case in which a front cover is turned upward so that an inside of the storage case is opened, and to a hinge structure of the storage case.

BACKGROUND

Conventionally, a storage case has been known, which includes a case main body having upper and front surfaces being opened, and a cover body having upper and front covers which cover the upper and front surfaces of the case main body, respectively. The front cover is connected to the upper cover through a hinge and is hung from the upper cover. The front cover is turned upward/downward between a closed state and an opened state to open/close the storage case.

In such a storage case, in order to hold the front cover in a state where the front cover is turned upward and raised, a locking projection and an engagement member are provided in a hinge structure between the front cover and the upper cover. When the front cover is turned upward and raised to a predetermined angle, the locking projection comes into contact with the engagement member. When the front cover is further turned upward from the predetermined angle so that the locking projection passes over the engagement member, and then afterward the front cover is not able to return (to be turned downward) to the closed state by a self-weight of the front cover (see, for example, Japanese Patent No. 5721688).

Specifically, in the storage case described in Japanese Patent No. 5721688, in the hinge structure between the upper cover and the front cover, the locking projection is formed on the front cover and a projection is also provided on the upper cover as the engagement member. When the front cover is turned upward to the predetermined angle, the locking projection passes over the engagement member and engages with the engagement member. Thereby, the front cover is prevented from being turned downward and being closed by the self-weight and the front cover can be held in the opened state.

Similarly, Japan Patent No. 3161698 discloses a container having a turnable upper cover, and a hinge structure capable of holding the upper cover in an opened state.

SUMMARY

Technical Problem

However, a cover body of a storage case is made of material such as polypropylene and the like and the locking projection and the cover body are integrally formed by an injection molding. Thus, the locking projection has increased thickness which causes occurrence of so-called sink marks, and therefore a dimension of the locking projection becomes unstable and varies from one product to another. This can result in produce failure. For example, when the locking projection is large, a force required to pass over the engagement member becomes too large, and when the locking projection is small, the engagement between the locking projection and the engagement member cannot be sustained with the self-weight of the cover body and the front cover cannot be locked.

Furthermore, in the hinge structures described in Japan Patent No. 5721688 and Japan Patent No. 3161698, the locking projection and the engagement member have small widths in a rotational direction. Accordingly, an internal stress is released at once at the moment the locking projection passes over the engagement member and thus a comparatively loud sound is generated. Moreover, since a large force is applied to both the locking projection and the engagement member when the engagement member passes over the locking projection, due to the abrasion after repeated use, the engagement member and the locking projection are worn away and the engagement therebetween becomes less effective and the cover cannot be locked (low durability).

Accordingly, an object of an embodiment of the present invention is to provide a storage case and a hinge structure thereof, in which a locking convex part and an engagement part are provided in the hinge structure between an upper cover and a front cover that is hung from the upper cover, to hold the front cover in a state where the front cover is turned upward, and which can improve dimensional stability of the locking convex part in a manufacturing process. Another object of an embodiment of the present invention is to suppress sounds generated when the locking convex part passes over the engagement part. Yet another object of an embodiment of the present invention is to prevent the locking convex part and the engagement part from wearing away due to the locking convex part repeatedly passing over the engagement part, and thereby to suppress decreased function of holding the cover.

Solution to Problem

A storage case according to an embodiment of the present invention includes a front cover disposed at a front side of the storage case; a top plate; and a hinge structure, an upper side of the front cover being rotatably connected to the top plate via the hinge structure. An outwardly protruding locking convex part is formed on the upper side of the front cover. In a first opened state in which the front cover is turned upward about the upper side of the front cover as an axis, the locking convex part comes into contact with an engagement part formed on the top plate. When the front cover is further turned upward from the first opened state and becomes in a second opened state in which the engagement part passes over the locking convex part, the locking convex part engages with the engagement part so that the front cover is locked in the second opened state. The locking convex part is recessed from a rear side of the front cover to be in a shell-shaped form.

According to the above configuration, the locking convex part engaging with the engagement part to lock the front cover in the second opened state is formed in a shell-shaped form by being recessed from the rear side of the front cover. Thereby, sink marks is prevented from occurring at the locking convex part during shaping or molding the front cover, and thus dimension stability of the locking convex part during manufacturing the front cover can be improved.

In the storage case according to the above embodiment, the locking convex part may have a slope surface positioned at a side of the engagement part when the front cover is in a closed state, and a locking surface positioned at a side of the engagement part when the front cover is in the second opened state. The slope surface may gently slope toward a top portion of the locking convex part such that contact stress between the locking convex part and the engagement part gradually increases when the front cover is turned upward from the first opened state to the second opened state. The locking surface may abruptly decrease the contact stress when the front cover is shifted from the first opened state to the second opened state, and, when a self-weight of the front cover acts on the front cover to turn the front cover toward the closed state in the second opened state, the locking surface may come into contact with the engagement part so that the front cover is held in the second opened state.

According to the above configuration, the front cover can be held in the second opened state by the locking surface, and the slope surface prevents sound from being generated by the engagement part passing over the locking convex part when the front cover is returned to the first opened state from the second opened state, and the engagement part and the locking convex part can be prevented from wearing away due to the abrasion.

A hinge structure in a storage case according to another embodiment of the present invention, which rotatably connects an upper side of a front cover and a top plate of the storage case, includes an outwardly protruding locking convex part formed on the upper side of the front cover. In a first opened state in which the front cover is turned upward about the upper side of the front cover as an axis, the locking convex part comes into contact with an engagement part formed on the top plate. When the front cover is further turned upward from the first opened state and becomes in a second opened state in which the engagement part passes over the locking convex part, the locking convex part engages with the engagement part so that the front cover is locked in the second opened state. The locking convex part is recessed from a rear side of the front cover to be in a shell-shaped form.

According to the above configuration, the locking convex part engaging with the engagement part to lock the front cover in the second opened state is formed in a shell-shaped form by being recessed from the rear side of the front cover. Thereby, sink marks is prevented from occurring at the locking convex part during shaping or molding the front cover, and thus dimension stability of the locking convex part during manufacturing the front cover can be improved.

According to an embodiment of the present invention, the locking convex part engaging with the engagement part to lock the front cover in the second opened state is formed in a shell-shaped form by being recessed from the rear side of the front cover. Thereby, sink marks is prevented from occurring at the locking convex part during shaping or molding the front cover, and thus dimension stability of the locking convex part during manufacturing the front cover can be improved.

DETAILED DESCRIPTION

Hereinafter, embodiments of the present invention will be described by reference to the drawings. The embodiments described hereinafter are merely illustrative examples and do not limit the scope of the present invention thereto. Various modifications or changes in specific configurations can be made according to the embodiments.

Figure 1:
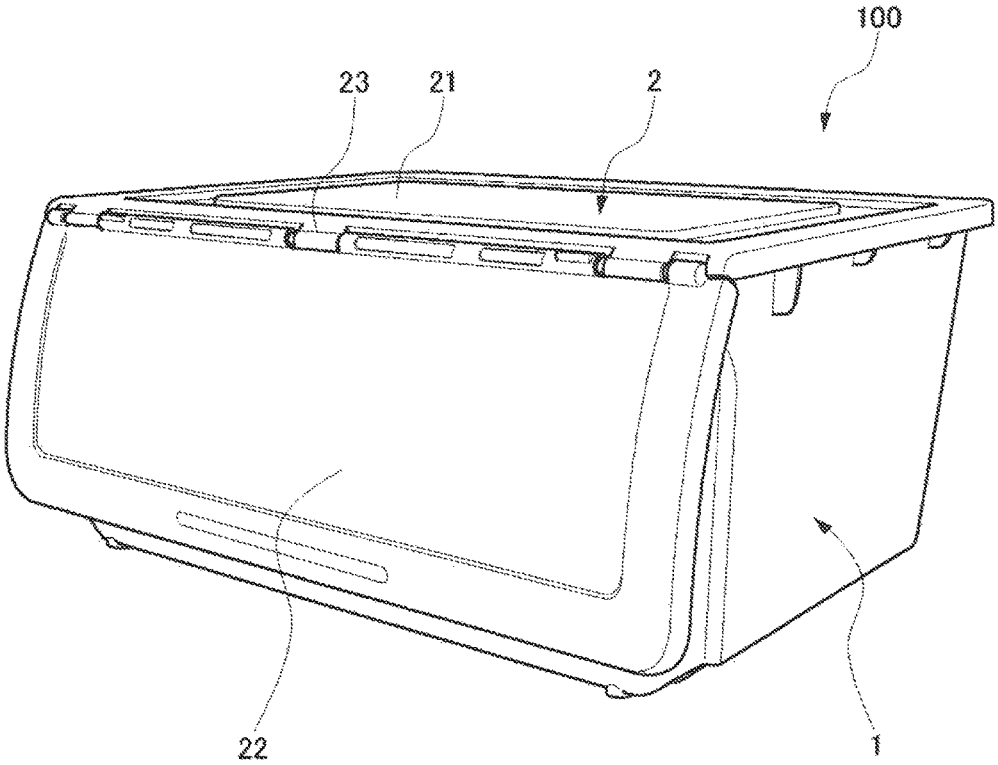
FIG. 1 is a perspective view showing a general configuration of a storage case of an embodiment of the present invention.

FIG. 1 is a perspective view showing a general configuration of a storage case of an embodiment of the present invention. The storage case 100 includes a case body 1 and a cover body 2 attached to the case body 1, and has a substantially rectangular parallelepiped shape as a whole. The case body 1 is formed in a substantially rectangular parallelepiped shape having an opening at an upper surface and an opening at a front surface. The cover body 2 has a top plate or an upper cover 21 and a front cover 22, which are rotatably connected to each other via a hinge structure 23. The cover body 2 is attached to the case body 1 such that the top plate 21 covers the upper surface opening of the case body 1 and the front cover 22 covers the front surface opening of the case body 1.

The top plate 21 and the front cover 22 are respectively formed in rectangular plate shapes such that the top plate 21 covers the upper surface opening of the case body 1 and the front cover 22 covers the front surface opening of the case body 1. The hinge structure 23 is provided between an upper side of the front cover 22 and a front side of the top plate 21. Via the hinge structure 23, the top plate 21 and the front cover 22 are rotatably connected about an axis along the side.

Figure 2:
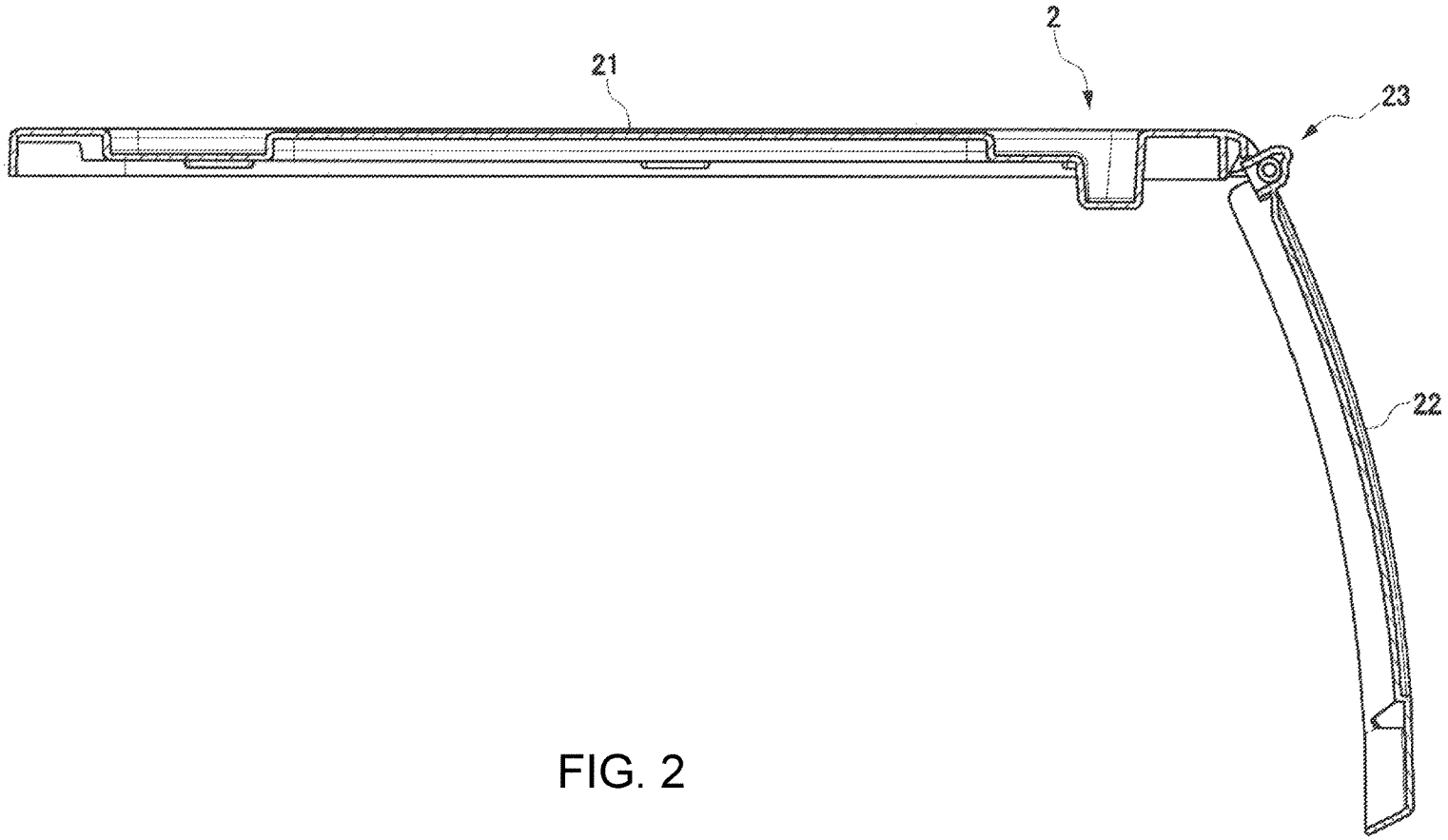
FIG. 2 is a cross-sectional view of a cover body of an embodiment of the present invention.

FIG. 2 is a cross-sectional view of the cover body 2 viewed from a side surface of the cover body 2. In the storage case 100, by detaching the cover body 2 from the case body 1, the upper surface and the front surface are opened and items (for example, clothes and the like) to be stored can be taken in and out. When the cover body 2 is kept attached on the case body 1, by turning the front cover 22 upward, an inside of the storage case 100 can be opened and the items can be taken in and out. A plurality of storage cases 100 can be used as being stacked vertically. As described above, since the inside of the storage case 100 can be opened without detaching the cover body 2 from the case body 1, while the plurality of storage cases 100 are kept stacked vertically, the items for each of the plurality of storage cases 100 can be taken in and out.

Specifically, in a state where the cover body 2 is attached to the case body 1, by lifting a lower side of the front cover 22 upward and turning the front cover 22 upward, the front cover 22 is, via the hinge structure 23, rotated and turned upward in relation to the top plate 21 about the upper side of the front cover 22 as a rotation axis. Thereby, the front surface of the storage case 100 is opened. That is, the front cover 22 is, at the upper side of the front cover 22, rotatably hung from the front side of the top plate 21 via the hinge structure 23.

Further, the hinge structure 23 is provided with locking means to hold a posture of the cover body 2 in a state where the front cover 2 is turned upward. By the locking means, the front cover 22 is held in a posture where the front cover 22 is turned at a substantially 60 degrees from a position where the front cover 22 closes the front surface, about the upper side of the front cover 22 as the rotation axis. Hereinafter, a state where the front cover 22 covers the front surface of the case body 1 is referred to as a closed state. A state where the front cover 22 is held by the locking means is referred to as a second opened state; a state where the front cover 22 is between the closed state and the second opened state is referred to as a first opened state, and a state where the front cover 22 is further opened up to a limit from the second opened state is referred to as a third opened state. The front cover 22 can be in the second opened state through the first opened state from the closed state, and can be returned to be in the closed state from the second opened state through the first opened state. Furthermore, a locking mechanism can be provided, which locks the front cover 22 in the closed state by engaging the front cover 22 with the case body 1 at a vicinity of the lower side of the front cover 22.

As described above, since the front cover 22 can be turned upward and held its posture in the second opened state, a user does not need to hold the front cover 22 to prevent the front cover 22 from closing due to the self-weight of the front cover 22 and to hold the front cover 22 in the opened state. Thus, the user can use both hands to take items in and/or out.

Figure 3:
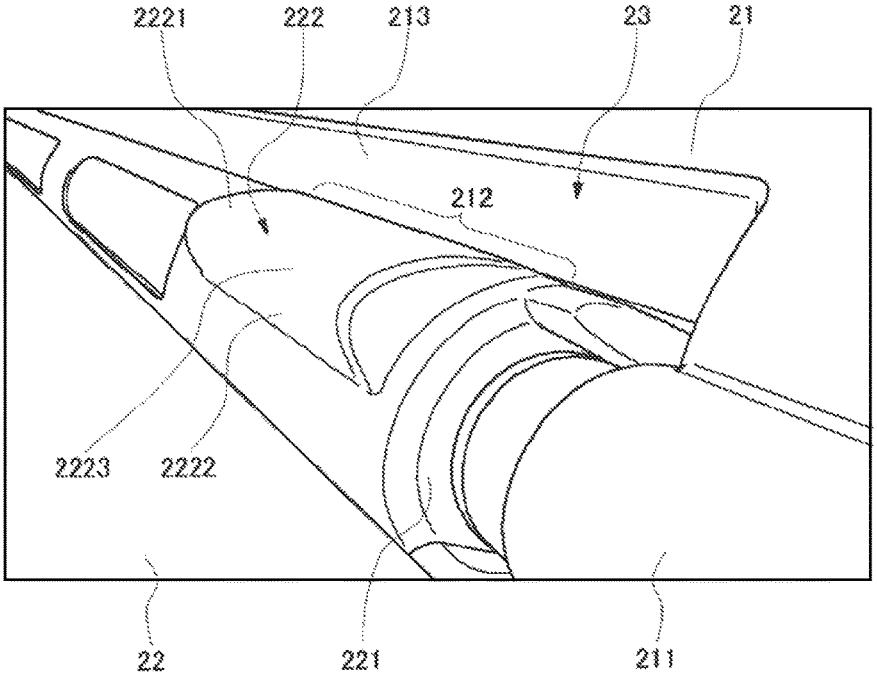
FIG. 3 is an enlarged perspective view of a hinge structure of the storage case of an embodiment of the present invention, viewed from outside.
Figure 4:
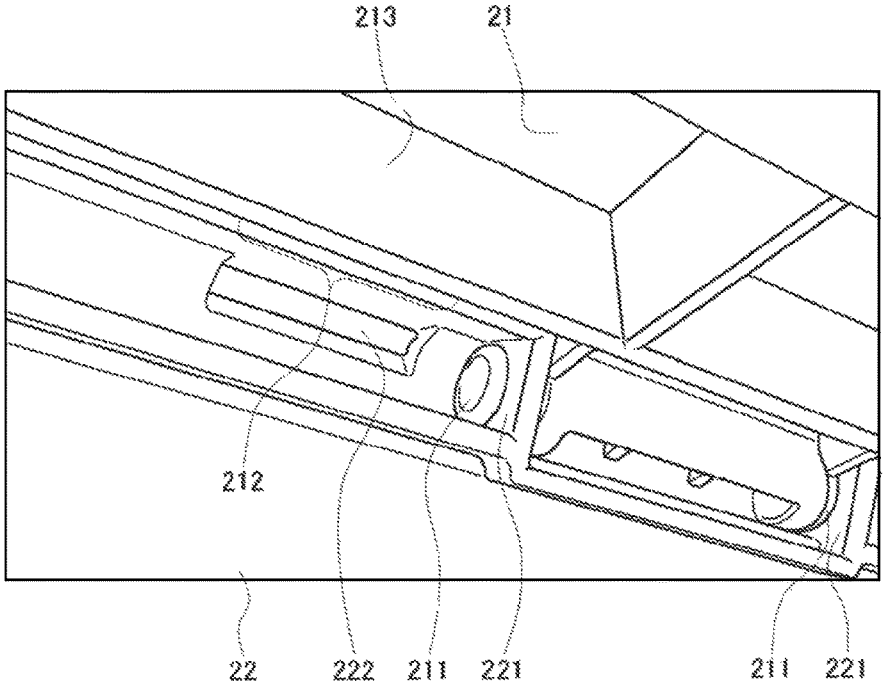
FIG. 4 is an enlarged perspective view of the hinge structure of the storage case of an embodiment of the present invention, viewed from inside.

FIG. 3 is an enlarged perspective view of the hinge structure 23, viewed from outside. FIG. 4 is an enlarged perspective view of the hinge structure 23, viewed from inside. FIGS. 3 and 4 show a state where the front cover 22 is in the closed state. A shaft 211 is provided integrally with the top plate 23 at a forward position and/or a downward position from the front side of the top plate 21. The shaft 211 extends in a direction along the front side of the top plate 21. The shaft 211 is provided at three positions on a front surface of the top plate 21.

A bearing 221 is provided on the upper side of the front cover 22 at a position corresponding to a position of the shaft 211 so as to protrude upward and/or rearward. In the bearing 221, a hole capable of receiving a tip portion of each shaft 211 is formed. The shaft 211 and the bearing 221 constitute the hinge structure 23. By supporting the shaft 211 via the bearing 221, the front cover 22 is rotatably supported on the front side of the top plate 21 about the upper side of the front cover 22 (the shaft 211 at the front side of the top plate 21) as the rotation axis.

In a vicinity of the hinge structure 23 at the upper side of the front cover 22, a locking convex part 222, which protrudes toward outside (forward and upward), is formed. A plate-shaped hung portion 213, which is hung down vertically, is integrally formed on the front side of the top plate 21. As describe below, a portion of the hung portion 213, which corresponds to the locking convex part 222 is an engagement part 212. The locking convex part 222 is positioned at a front side from the hung portion 213 of the top plate 21 when the front cover 22 is in the closed state. The locking convex part 222 is positioned at a rear side from the hung portion 213 of the top plate 21, when the front cover 22 is between the second opened state and the third opened state (including the second opened state and the third opened state).

As shown in FIG. 3, the locking convex part 222 has a top portion 2223 which is the most protruding portion, and has a slope surface which is a gentle slope at one side from the top portion 2223, and a locking surface 2222 which is a steep slope at the other side from the top portion 2223. As shown in FIG. 3, when the front cover 22 is in the closed state, the slope surface 2221 is positioned at a side of the hung portion 213 (a side of the engagement part 212) from the top portion 2223. As described below, the locking surface 2222 is positioned at a side of the hung portion 213 (a side of the engagement part 212) from the top portion 2223, when the front cover 22 is between the second opened state and the third opened state. As described above, by the two surfaces 2221, 2222 of the locking convex part 222, having gentle and steep slopes, respectively, the front cover 22 is formed in a cylindrical cam shape at a portion of the locking convex part 222.

As clearly shown in FIG. 4, the locking convex part 222 has a shell shaped hollow body. The front cover 22 is manufactured by an injection molding using resin material such as polypropylene and the like. The shell shape is formed as being hollowed or recessed from a rear side to be a uniform wall-thickness structure. If the locking convex part 222 is formed as filled thickness structure, sink marks are generated at portions of the locking convex part during the injection molding, and thus the locking convex part may not be formed to have an originally designed height. To the contrary, according to the present embodiment, the uniform wall-thickness structure is formed by being hollowed or recessed from the rear side, and therefore the height of the locking convex part 222 can be uniformly set.

Figure 5:
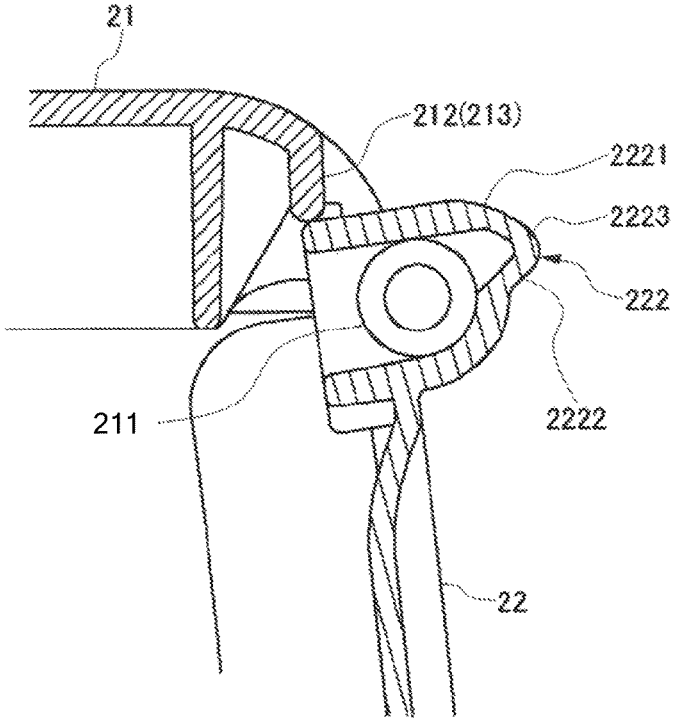
FIG. 5 is an enlarged perspective view of locking means (in a closed state) of an embodiment of the present invention.
Figure 6:
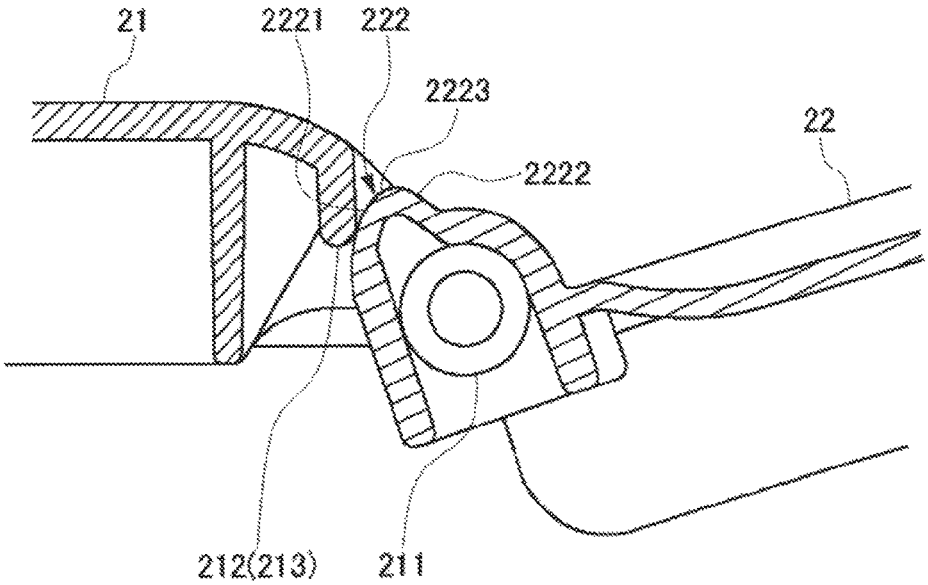
FIG. 6 is an enlarged perspective view of the locking means (in a first opened state) of an embodiment of the present invention.
Figure 7:
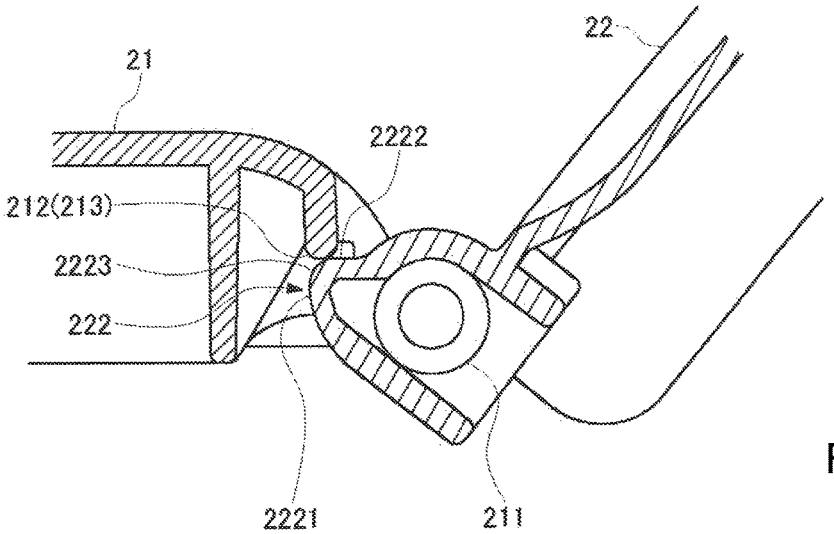
FIG. 7 is an enlarged perspective view of the locking means (in a second opened state) of an embodiment of the present invention.
Figure 8:
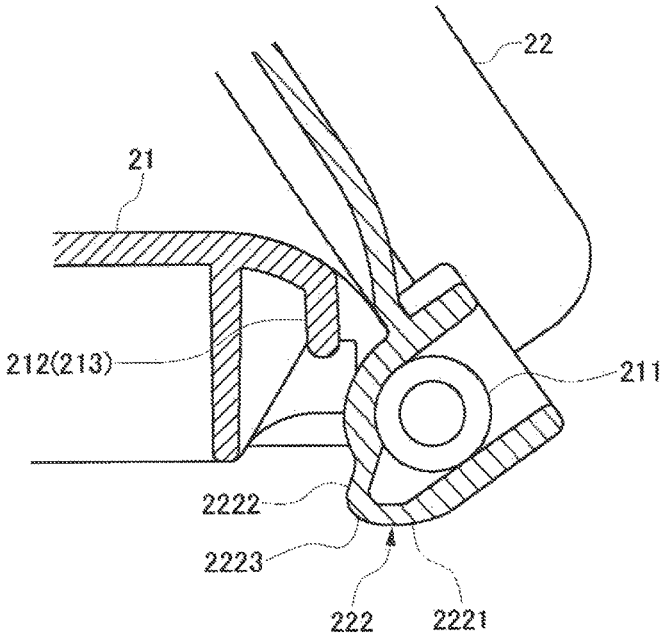
FIG. 8 is an enlarged perspective view of the locking means (in a third opened state) of an embodiment of the present invention.

FIGS. 5 to 8 are views showing an operation of the locking means including the locking convex part 222 and the engagement part 212. FIG. 5 shows the closed state, FIG. 6 shows the first opened state, FIG. 7 shows the second opened state, and FIG. 8 shows the third opened state. In case where the user turns the front cover 22 upward to open the front surface opening of the storage case 100, the front cover 22 can be in the third opened state shown in FIG. 8 from the closed state shown in FIG. 5, through the first opened state shown in FIG. 6 and then the second opened state. In case where the user closes the front surface opening of the storage case 100, the front cover 22 can be in the closed state shown in FIG. 5 from the third opened state shown in FIG. 8, through the second opened state shown in FIG. 7 and then the first opened state shown in FIG. 6.

If the user lifts the lower side of the front cover 22 upward from the closed state shown in FIG. 5 and turns the front cover 22 upward about the upper side of the front cover 22 as the rotation axis, the front cover 22 becomes in the first opened state, and as shown in FIG. 6, the slope surface 2221 of the locking convex part 222 comes into contact with the engagement part 212. If the user further turns the front cover 22 upward from the above state, the hung portion 213 including the engagement part 212 gradually deforms and contact stress at a contact portion between the locking convex part 222 and the engagement part 212 gradually increases.

The deformation of the hung portion 213 and the contact stress become maximized when the locking convex part 222 comes into contact with the engagement part 212 at the top portion 2223 (farthest portion from the shaft 211), that is, when the front cover 22 is in a state between the states shown in FIGS. 6 and 7. When the engagement part 212 passes over the top portion 2223, since the locking surface 222 has a comparatively steep slope, the contact stress is abruptly released and the front cover 22 becomes in the state shown in FIG. 7. The locking convex part 222 is positioned at an inner side of the hung portion 213, and the engagement part 212 completely passes over the locking convex part 222.

When the user 4 further turns the front cover 22 upward, the locking convex part 222 moves away from the engagement part 212 and the front cover 22 is turned further upward to be in the third opened state shown in FIG. 8. Once the engagement part 212 passes over the locking convex part 222, even if the front cover is turned downward toward the closed state afterward, the locking surface 2222 of the locking convex part 222 comes into contact with the engagement part 212 in the second opened state shown in FIG. 7, and the front cover 22 is prevented from turning downward. When the user further pushes the front cover 222 downward from the second opened state toward the closed state to provide a rotary torque to the front cover 22, then the hung portion 213, while deforming, passes over the locking convex part 222 to be in the first opened state shown in FIG. 6, then afterwards to be in the closed state shown in FIG. 5.

In case where the user does not provide a force to the front cover 22 in a direction toward the closed state in the second opened state shown in FIG. 7, a rotary torque due to the self-weight of the front cover 22 acts on the front cover 22. However, the rotary torque is not large enough to allow the engagement part 212 to pass over the locking convex part 222, and therefore the front cover 22 is locked by the locking means in the state shown in FIG. 7 and held in the second opened state. That is, even though the user does not hold or support the front cover 22, the second opened state can be maintained.

As described above, the height of the locking convex part 222 is a factor to determine a rotary torque required for shifting from the second opened state to the first opened state. Thus accuracy of the height of the locking convex part 222 is required. If the height of the locking convex part 222 is too small than a designed value, the front cover 22 is shifted from the second opened state to the first opened state and to the closed state with a very weak force. In this case, the second opened state cannot be maintained against the rotary torque due to the self-weight of the front cover 22 acting on the front cover 22. According to the present embodiment, the front cover 22 is formed as the uniform wall-thickness structure by being hollowed or recessed from the rear side of the locking convex part 22. Thus, even in case where the locking convex part 222 is formed by the injection molding, it is easy to provide accuracy and a dimension of the locking convex part 222 during manufacturing the front cover 22 becomes stable.

The locking convex part 222 according to the present embodiment has the slope surface 2221 and the locking surface 2222, which are both slope surfaces. Thus, the stress on the engagement part 212 is not abruptly released at the moment the front cover 22 is shifted from the first opened state to the second opened state. Even at the moment the front cover 22 is shifted from the second opened state to the first opened state, the stress on the engagement part 212 is gradually released along with the front cover 22 turning downward. Accordingly, sounds generated between the first opened state and the second opened state can be suppressed.

Furthermore, the locking convex part 222 of the present embodiment is formed in a cylindrical cam shape having the slope surface 2221. Thereby, the locking convex part 222 has a predetermined width in a circumferential direction on the slope surface 2221 and slides with the engagement part 212 over the predetermined width. That is, the locking convex part 222 has a broad contact (friction) area with the engagement part 212 compared to the conventional locking projection. Thus, even though the slope surface 2221 of the locking convex part 222 is worn away due to friction, this does not seriously affect the function of holding the cover and decrease in the function of holding the cover can be largely suppressed.

The invention claimed is:

1. A storage case comprising:

a case body; and a cover body, the cover body comprising:

a front cover disposed at a front side of the storage case;

a top plate; and a hinge structure, an upper side of the front cover being rotatably connected to the top plate via the hinge structure, wherein an outwardly protruding locking convex part is formed on the upper side of the front cover, in a first opened state in which the front cover is turned upward about the upper side of the front cover as an axis, the locking convex part comes into contact with an engagement part formed on the top plate, and when the front cover is further turned upward from the first opened state and becomes in a second opened state in which the engagement part passes over the locking convex part, the locking convex part engages with the engagement part so that the front cover is locked in the second opened state, the locking convex part is recessed from a rear side of the front cover to be in a shell-shaped hollow body form, the locking convex part has a slope surface positioned at a side of the engagement part when the front cover is in a closed state, and a locking surface positioned at a side of the engagement part when the front cover is in the second opened state, the slope surface gently slopes toward a top portion of the locking convex part such that contact stress between the locking convex part and the engagement part gradually increases when the front cover is turned upward from the first opened state to the second opened state, the locking surface abruptly decreases the contact stress when the front cover is shifted from the first opened state to the second opened state, and, when a self-weight of the front cover acts on the front cover to turn the front cover toward the closed state in the second opened state, the locking surface comes into contact with the engagement part so that the front cover is held in the second opened state, the case body is formed in a substantially rectangular parallelepiped shape having an opening at an upper surface and an opening at a front surface, the cover body has the top plate and the front cover which are rotatably connected to each other via the hinge structure, the cover body is attached to the case body such that the top plate covers the upper surface opening of the case body and the front cover covers the front surface opening of the case body, in the storage case, by detaching the cover body from the case body, the upper surface and the front surface are opened and items to be stored can be taken in and out, and when the cover body is kept attached on the case body, by turning the front cover upward, an inside of the storage case can be opened and items can be taken in and out.

2. A hinge structure in a storage case, which rotatably connects an upper side of a front cover and a top plate of the storage case, the storage case comprising a case body and a cover body, the hinge structure comprising:

an outwardly protruding locking convex part formed on the upper side of the front cover, wherein in a first opened state in which the front cover is turned upward about the upper side of the front cover as an axis, the locking convex part comes into contact with an engagement part formed on the top plate, and when the front cover is further turned upward from the first opened state and becomes in a second opened state in which the engagement part passes over the locking convex part, the locking convex part engages with the engagement part so that the front cover is locked in the second opened state, the locking convex part is recessed from a rear side of the front cover to be in a shell-shaped hollow body form, the locking convex part has a slope surface positioned at a side of the engagement part when the front cover is in a closed state, and a locking surface positioned at a side of the engagement part when the front cover is in the second opened state, the slope surface gently slopes toward a top portion of the locking convex part such that contact stress between the locking convex part and the engagement part gradually increases when the front cover is turned upward from the first opened state to the second opened state, the locking surface abruptly decreases the contact stress when the front cover is shifted from the first opened state to the second opened state, and, when a self-weight of the front cover acts on the front cover to turn the front cover toward the closed state in the second opened state, the locking surface comes into contact with the engagement part so that the front cover is held in the second opened state, the case body is formed in a substantially rectangular parallelepiped shape having an opening at an upper surface and an opening at a front surface, the cover body has the top plate and the front cover which are rotatably connected to each other via the hinge structure, the cover body is attached to the case body such that the top plate covers the upper surface opening of the case body and the front cover covers the front surface opening of the case body, in the storage case, by detaching the cover body from the case body, the upper surface and the front surface are opened and items to be stored can be taken in and out, and when the cover body is kept attached on the case body, by turning the front cover upward, an inside of the storage case can be opened and items can be taken in and out.

* * * * *